United States Patent [19]

Rickert

[11] 4,116,651

[45] Sep. 26, 1978

[54] HEAT SINK TEMPERATURE STABILIZED EVAPORATOR COIL

[76] Inventor: Glenn E. Rickert, Community Bank Building, Huntington, Ind. 46750

[21] Appl. No.: 716,789

[22] Filed: Aug. 23, 1976

[51] Int. Cl.[2] ..... F25D 3/00; F25D 17/04; F25D 11/00; F25D 3/10

[52] U.S. Cl. ..... 62/59; 62/406; 62/430; 62/529

[58] Field of Search ..... 62/59, 430, 406, 529

[56] References Cited

U.S. PATENT DOCUMENTS

| | | | |
|---|---|---|---|
| 188,923 | 3/1877 | Mack | 62/406 |
| 1,678,678 | 7/1928 | Moore | 62/59 |
| 2,421,819 | 6/1947 | Vandenberg | 62/59 |
| 3,653,221 | 4/1972 | Angus | 62/59 |
| 3,747,362 | 7/1973 | Mercer | 62/176 |
| 4,050,262 | 9/1977 | Mehnert | 62/160 |

*Primary Examiner*—Lloyd L. King
*Attorney, Agent, or Firm*—Gust, Irish, Jeffers & Rickert

[57] ABSTRACT

A temperature stabilized refrigeration evaporator coil for use with a mechanical refrigeration compressor and condenser is disclosed which gathers and retains its own latent heat sink material to temperature stabilize its air heat exchange surfaces. The evaporator is adapted to condense water from the air it is cooling, and to retain an adequate quantity of that water to employ as a liquid-solid phase change, latent heat sink to temperature stabilize the evaporator, air heat exchange surfaces, so that they do not become excessively cold during the on cycle of the compressor, and so that they do not become excessively warm during extended periods of the off cycle of the compressor.

The unit is adapted to allow its manufacture, sale and transportation in a dry condition without the additional weight and spillage problems of the heat sink water, and to assure the user of the unit that it will operate properly even though he neglects to initially charge it, or to later maintain it with the proper quantity of heat sink water.

2 Claims, 3 Drawing Figures

HEAT SINK TEMPERATURE STABILIZED EVAPORATOR COIL

BACKGROUND OF THE INVENTION

This invention relates to mechanical refrigeration compressor operated evaporation coils which absorb heat.

This invention is provided because it is frequently desirable to maintain a refrigeration evaporation coil in a continually cold condition within a limited temperature range while it is being subjected to alternately high and low heat loads.

In the present state of the art when an evaporator must be maintained at a constant temperature under varying heat loads either a re-heat system or a hot gas bypass system is used.

In a re-heat system, cold is continually provided and when that much cold is not needed, excess cold is eliminated by an electrical heater or by the heat output of the condenser of the system. Since the compressor runs continually regardless of the load it is obviously inefficient and wasteful of energy.

In a hot gas bypass control system the condenser is bypassed and the hot output of the compressor goes directly back into the compressor intake, or goes directly into the evaporator to restrict the cooling capacity of the evaporator. The compressor here also runs continually never turning off. It is also obvious here that this system produces controlled cold rather inefficiently and wastes much electrical energy when serving lighter heat loads.

A commonly used method to limit the output of a refrigeration system when it is loaded to less than its capacity is to cycle the compressor on and off, and cool the evaporator coil spasmodically. If one attempts, however, to use this system to maintain an evaporator coil in a continually cold condition within a limited temperature range under less than a maximum load, it requires such short periods of on and off, that the frequent starts of the compressor consume excess electricity and these short and frequent cycles generally lead to early compressor failure.

One object of my invention is to provide an energy saving temperature stabilized evaporator coil which, under different heat loads, remains within a limited temperature range during extended periods of the off cycle of the compressor serving it, and which does not become excessively cold during the on cycle of the compressor serving it.

It is a prime object of this invention to provide a self water filling refrigeration evaporator heat sink coil which will condense moisture from the air passing through it and which will hold and maintain a desired amount of that moisture in the form of water and employ it as a heat sink.

It is a further object of this invention to provide a trouble free and highly efficient evaporator coil which is temperature stabilized by a heat sink employing the latent heat effect of condensed and retained water being changed in state or phase between liquid and solid.

A salient object of this invention is to provide a temperature stabilized evaporator coil which stores water in a fashion whereby the freezing of that water does not damage the system employing it.

A principal object of the invention is to provide an evaporator coil with air fins operating near the freezing temperature of water yet which fins will not easily frost up and restrict the air flow through it.

SUMMARY OF THE INVENTION

The foregoing objects as well as numerous other objects, features and advantages of the present invention are achieved by providing a refrigeration evaporator coil which is temperature stabilized in a desired limited temperature range both during the on cycle of the compressor and during the off cycle of the compressor by the employment of a heat sink comprising the latent heat of the phase change of water between solid and liquid.

The water of the heat sink is provided by collecting the water vapor in the air passing through the evaporator by condensing it as liquid droplets or even as frost on the cold evaporator parts. The frost is melted and the droplets are trapped in a recess or in pockets associated with the evaporator coil and air heat exchange surfaces, and the droplets are allowed to build up as a substantial quantity of water to be held and maintained as a latent heat sink to temperature stabilize the air heat exchange surfaces of the evaporator.

With appropriate modification, the present invention is particularly suited to use in conjunction with the structure disclosed in my U.S. Pat. No. 3,938,348, the disclosure of which is incorporated herein by reference.

Thus is provided a refrigeration evaporator coil which, because of its limited temperature range, is useful in the coldest possible storage of vegetables and other foods without freezing them, useful to condense moisture from air to dehumidify a dwelling without frosting shut the cooling fins and for other uses requiring a more economical to operate evaporator coil which will maintain a relatively constant temperature even though subjected to varying heat loads.

DESCRIPTION OF THE PREFERRED EMBODIMENT

Figure 1:
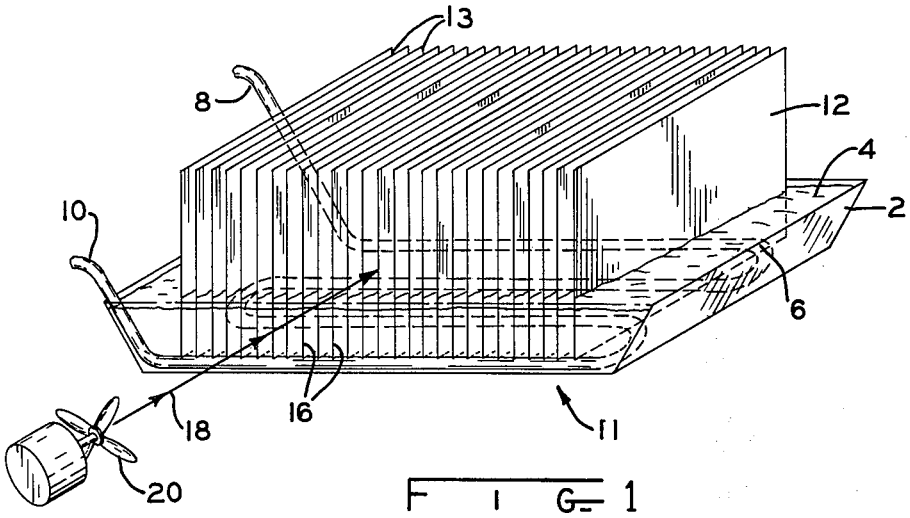
FIG. 1 is a phantom view of one form of the invention where the water retainer is a tray and the heat exchange surfaces are plates standing partly in water and partly in the air.

FIG. 1 is the preferred form of the invention where the evaporator coil unit 11 has a tray 2 of ice water 4 with a serpentine refrigeration pipe 6 traversing the bottom of the tray 2. Ends 8 and 10 of the serpentine refrigeration pipe 6 are provided to be connected to a refrigeration compressor and condenser to cause refrigerant to flow through the refrigeration pipe 6 to cool and to freeze the water 4. Tray 2 has retaining sides adapted to prevent damage to them from the expansion of water turning to ice. Sloping sides, as shown, instead of vertical sides, is one way to do this. Flexible sides, very strong sides or other methods could be provided.

Vertical plates 12, of heat conducting sheet material act as heat exchange fins. The top portions 13 of the plates 12 are exposed to the air 18 blown by fan 20 to pass between the top portions 13 of the plates 12. The bottom portion 16 of the plates 12 is immersed in the ice water 4. Heat is conducted by the plates from their top air portion to their bottom portion 16 in the ice water to melt the ice present.

When a sufficient amount of the ice in the water has been melted, the attached refrigeration compressor pumps refrigerant through the serpentine pipe 6 to freeze more of the water 4 into ice. When sufficient ice is produced the compressor turns off and rests until more ice is again needed. With a close association between the ice and the water, the ice water remains at about 32° F regardless whether the ice water is 80% ice and 20% water, or whether the ice water is 20% ice and 80% water.

In this manner the plates 12 are maintained within a limited temperature range even though the heat load of the humid air being cooled may vary, and even though the cooling effect of the compressor goes on and off.

In the initial use of the unit when it is first put into operation without water in the tray it supplies its own water. Of course water may be manually added whenever desired.

As humid air passes between the refrigeration cooled plates 12, moisture condenses on the surface of the plates from the air and runs down into the tray where it is retained. When the tray becomes full of water, additional condensed water simply overflows the tray to be used as needed or discarded. In this manner the tray is always self-maintained in a full condition. Spacers hold the plates so that air can pass between the plates for heat exchange.

Figure 2:
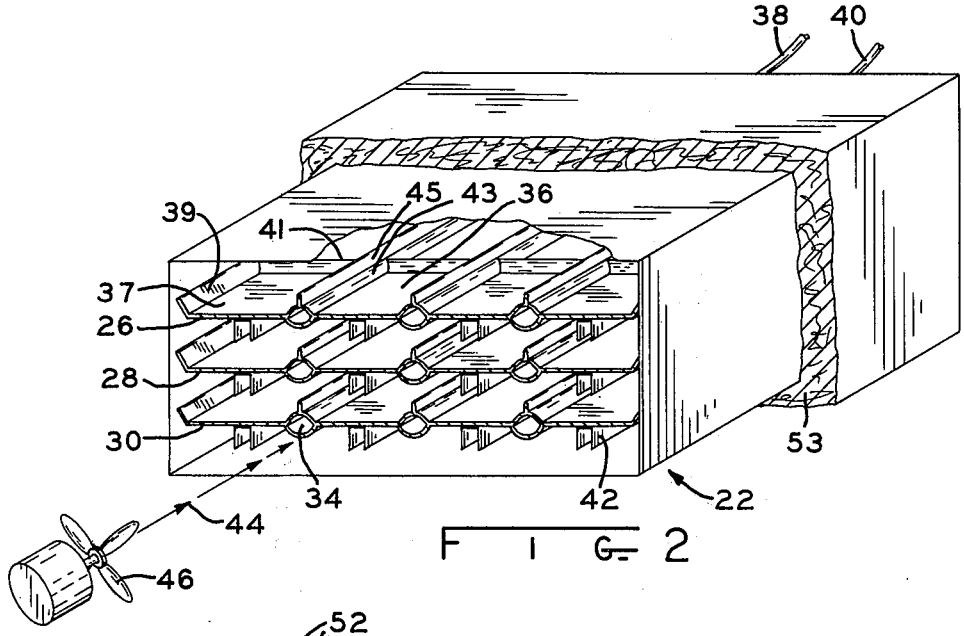
FIG. 2 is a perspective view partially in section of another form of the invention where the water retainers and refrigerant pipes are formed from sheet material and stacked as shelves, one above the other.

FIG. 2 is another form of the invention where the evaporator coil unit 22 employs a special refrigeration plate coil construction. Here especially adapted plate coils or refrigeration plates 26, 28 and 30 are oriented horizontally and stacked one above the other in a manner like shelves. Each shelf is a special refrigeration plate formed from sheet material to have refrigeration pipes 34 and water retaining pockets 36. Each shelf has its pipes connected to the pipes of another shelf and finally connected to pipes 38, 40 which are serviced by a refrigeration compressor. Each pocket 36 is formed of a bottom 37 and adjoined sloping side walls such as 39, 41 and 43.

Air passes over and under each shelf to exchange its heat with the cold shelf. Optional fins 42 project from the shelf to aid in heat exchange with the air and upwardly extending air heat exchange fins such as 45 may be provided.

Air 44 is driven through the assembly by fan 46.

Condensate on the surfaces of the shelves runs into the water retaining pockets 36 to be employed as the latent heat sink water.

Obviously, more than one tray of fins as shown in FIG. 1 can be employed, such as stacking one above the other, or one beside the other to work together as a single unit.

It is advantageous to insulate the evaporator unit for example by an insulating layer 53 so that it absorbs heat primarily only from the air going through it.

Figure 3:
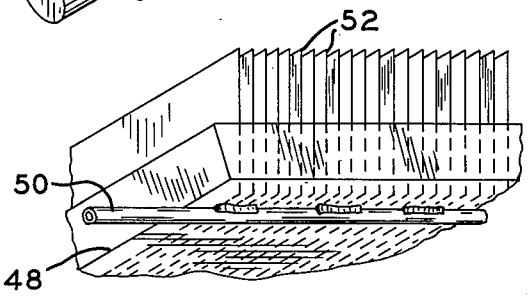
FIG. 3 illustrates a portion of a modified tray and evaporator coil according to the present invention.

In FIG. 3, a portion of the tray 48, which is similar to the tray 2 of FIG. 1, has the evaporator coil 50 welded or soldered to the bottom thereof or otherwise fastened thereto in good heat transfer relation while fins or upstanding plates 52 are disposed partially in the water accumulated in the tray as before.

The process of the present invention should now be clear. The temperature of the evaporator unit of a refrigeration system such as used in a food storage cabinet, a dehumidifier or a home air conditioner is stabilized throughout a plurality of cycles of the system compressor. The compressor is energized to cool the evaporator, and air is passed across the evaporator to cool the air and condense excess moisture. At least part of the condensate is retained in good heat transfer relation with the evaporator heat exchange surfaces, and continued operation of the compressor freezes the retained condensate. The compressor is then deenergized, however, air continues to pass across the evaporator to be cooled thereby which in turn melts at least part of the frozen condensate. The compressor is then again energized to cool the evaporator and change at least some of the retained condensate back to its solid phase. Thereby, during both the on cycle and the off cycle of the compressor, the air passing over the heat exchange surfaces of the evaporator is neither cooled too little or too much because of the stabilizing effect of the associated ice-water heat sink.

Thus, while the present invention has been described in a preferred form, numerous modifications will suggest themselves to those skilled in the art and accordingly the scope of the present invention is to be measured only by the appended claims.

What is claimed is:

1. The method of stabilizing the temperature of a refrigeration system evaporator throughout a plurality of cycles of the refrigeration system comprising:

energizing the system to cool the evaporator;

passing air across the evaporator to cool the air and condense excess moisture therefrom;

retaining at least part of the condensate in good heat transfer relation with the evaporator;

continuing operation of the system to freeze the thus retained condensate;

deenergizing the system while continuing to pass air across the evaporator until at least a portion of the frozen condensate has changed back to a liquid phase; and reenergizing the system to again cool the evaporator and refreeze the retained condensate when the temperature of the air passing across the evaporator coil exceeds a preferred dew point temperature to thereby maintain the temperature of the air passing across the evaporator coil generally below that preferred dew point temperature.

2. The method of claim 1 wherein the system is deenergized when a preferred amount of the retained moisture is in a solid phase.

* * * * *